United States Patent [19]

Janssens et al.

[11] Patent Number: 4,496,645

[45] Date of Patent: Jan. 29, 1985

[54] PROCESS FOR THE PRODUCTION OF A PHOTOGRAPHIC COLOR IMAGE BY IMAGE-WISE DYE DIFFUSION TRANSFER

[75] Inventors: Wilhelmus Janssens, Aarschot; Daniël A. Claeys, Mortsel, both of Belgium

[73] Assignee: Agfa-Gevaert, N.V., Mortsel, Belgium

[21] Appl. No.: 545,433

[22] Filed: Oct. 26, 1983

[30] Foreign Application Priority Data

Nov. 12, 1982 [GB] United Kingdom ..... 8232450

[51] Int. Cl.[3] ..... G03C 5/54; G03C 1/40; G03C 7/20

[52] U.S. Cl. ..... 430/239; 430/218; 430/447; 430/487

[58] Field of Search ..... 430/239, 218, 219, 223, 430/497, 487, 489, 599

[56] References Cited

U.S. PATENT DOCUMENTS

| | | | |
|---|---|---|---|
| 3,249,432 | 5/1966 | Haas | 430/216 |
| 4,139,379 | 2/1979 | Chasman et al. | 430/223 |
| 4,139,389 | 2/1979 | Hinshaw et al. | 430/223 |
| 4,232,107 | 1/1980 | Janssens | 430/218 |
| 4,353,975 | 10/1982 | Janssens et al. | 430/218 |
| 4,396,699 | 8/1983 | Janssens et al. | 430/218 |
| 4,440,849 | 4/1984 | Krafft | 430/218 |

*Primary Examiner*—Richard L. Schilling
*Attorney, Agent, or Firm*—A. W. Breiner

[57] ABSTRACT

A photographic color diffusion transfer process comprising the steps:

(1) image-wise photo-exposing a photographic material which contains on a support at least one waterpermeable silver halide emulsion layer, the silver halide of which essentially consists of silver chloride, and in operative contact therewith at least one non-diffusing ballasted dye or dye precursor which when contacted with an aqueous alkaline liquid remains immobile in a waterpermeable colloid layer, and in reduced state is capable of releasing (a) dye(s) or dye precursor(s), (2) treating the photographic material with an alkaline processing liquid in the presence of a silver halide developing agent, (3) maintaining said photographic material in contact with the alkaline processing liquid in the presence of said developing agent to release said dye or dye precursor in diffusible state; and (4) transferring at least a portion of said released dye or dye precursor to a non-light-sensitive layer and carrying out the development in the presence of a substance providing iodide ions, increasing speed and reducing color fog.

10 Claims, No Drawings

PROCESS FOR THE PRODUCTION OF A PHOTOGRAPHIC COLOR IMAGE BY IMAGE-WISE DYE DIFFUSION TRANSFER

The present invention relates to a process for the production of a photographic colour image by image-wise dye diffusion transfer.

In commonly known diffusion transfer colour processes a dye providing substance is associated with a silver halide emulsion. According to one embodiment a coloured image is produced by conversion of an initially non-diffusible product into a diffusible product as a result of a silver halide development related chemical reaction. The mobilized dyes or dye-precursors thus produced diffuse into a receiving layer where the final coloured image is retained.

Most frequently the transferred dye-image is to be a positive image of the original so that the dye diffusion transfer process should bring about an image reversal when the image recorded in a silver halide material is negative. This reversal can be achieved either in the silver halide development step or in the image-wise production of (a) diffusible dye(s) from initially non-diffusible dye providing substances.

Depending upon the type of silver halide emulsion used different kinds of dye providing systems are required to produce a positive transferred dye image.

If direct-positive silver halide emulsions are used positive image production with respect to the original requires that the dye providing system must yield (a) diffusible dye(s) in the non-exposed areas to an extent which is directly proportional to the degree of non-exposure, whereas no such diffusible dye(s) should be released in the exposed areas. Among the systems fulfilling this requirement are the so-called diffusible dye releasing (DDR) compounds described e.g. in U.S. Pat. No. 3,227,550—U.S. Pat. No. 3,443,940 and U.S. Pat. No. 3,751,406. Other suitable systems apply dye-releasing redox (DRR) compounds which cleave upon oxydation whereas their reduced state is stable to the processing conditions. When such DRR compounds are used in association with a developing silver halide emulsion of the direct-positive type cross-oxydation of the non-diffusible DRR compound with oxidized silver halide developer yield an alkali-labile oxidation product in the non-exposed areas only and hence a positive image-wise distribution of diffusible dye. Examples of image-wise cleaving DRR compounds are described in U.S. Pat. No. 3,628,952—GB Pat. No. 1,405,662—DE-OS No. 2,645,656 and Research Disclosures Nos. 12 82 (1974) and 15 157 (1976). For image reversal with negative silver halide emulsions the dye providing system should yield likewise diffusible dyes in the unexposed areas depending on the degree of exposure. So-called dye-developers, e.g. Those described in U.S. Pat. No. 2,983,606, are suitable for this purpose. These compounds are soluble in the alkaline processing fluids and hence are diffusible; in the exposed areas, however, cross-oxidation with oxidized silver halide developer will turn them into non-soluble, non-diffusible oxidation products.

According to another reversal process so-called IHO (Inhibited hydrolysis by oxydation) compounds can be used. The IHO compounds carry a ballast group and are initially immobile in the hydrophilic colloid layer wherein they are incorporated. Their main characteristic is that they are alkali-labile in reduced state so as to release a diffusible dye in the unexposed areas. In the exposed areas the IHO-compounds cross-oxidize with oxidized silver halide developer and are converted into their alkali-stable, still ballasted oxidized counterparts. Examples of IHO-compounds are described in DE-OS Nos. 2,402,900-2,543,902 and 2,654,213.

An alternative to these IHO-compounds are the IHR (Increased Hydrolysis by Reduction) compounds.

Said IHR-compounds are used in ballasted diffusion-resistant form and may be IHO-compounds in oxidized state or in general compounds wherefrom by reduction and hydrolysis a diffusible photographically useful group (PUG) is released. The IHR-compounds react neither directly nor indirectly with oxidizing substances, e.g. the oxidation product of developers, so that their diffusion resistance at the exposed areas cannot be changed. They are, however, capable of reacting with reducing compounds, e.g. by direct or indirect reaction with non-oxidized photographic developer which remains at the non-exposed areas of negative working silver-halide emulsion layers. By reduction a hydrolysable compound is obtained wherefrom a diffusion-mobile part being or including a photographically useful group e.g. dye or dye precursor is set free which is capable to diffuse into an image receiving layer where it is fixed. Examples of IHR compounds are described in the U.S. Pat. Nos. 4,139,379 and 4,139,389 and in the published European patent Application Nos. 0004399 and 0038092.

As explained in the published European Patent Application No. 0049002 it has been established experimentally that in a dye diffusion transfer process operating with said IHR-compounds unwanted dye release takes place to some extent in the photo-exposed area of a photographic negative working multilayer multicolour material containing these compounds because unaffected, i.e. unoxidized, developing agent can diffuse from neighbouring layers into the area containing already developed silver halide. Further it has been established experimentally that when carrying out the development of said dye-releasing photographic multilayer multicolour material in the presence of a silver halide solvent capable of forming an alkali-soluble and reducible silver complex compound, said unwanted dye release from photo-exposed area is diminished and even can be ruled out completely.

Explicitely mentioned silver halide solvents for that purpose are thiosulphates, thiocyanates thiosugars and thioetheracids e.g. $HOOC—(CH_2—S—CH_2)_3—COOH$ or an active methylene compound having the methylene group linked directly to sulphonyl groups as e.g. in $H_3C—SO_2—CH_2—SO_2—CH_3$.

Preferably used are however, water-soluble thiosulphates, particularly alkali metal thiosulphate or ammonium thiosulphate.

The use of a halogen salt e.g. an iodide as a colour fastness stabilizer in a dye diffusion transfer process operating with dye developers has been described and claimed already e.g. in the U.S. Pat. No. 3,249,432. According to said process it is important that the finished coloured image is treated with a solution comprising the particular salt.

It has now been found that when in a dye diffusion transfer process operating with IHR-compounds in operative association with (a) silver halide emulsion layer(s), wherein the silver halide essentially consists of silver chloride a higher development speed associated with a reduction in colour fog is obtained when the development of said layer(s) is carried out in the presence of free iodide ions.

The photographic colour diffusion transfer process according to the present invention comprises the steps:

(1) image-wise photo-exposing a photographic material which contains on a support at least one waterpermeable silver halide emulsion layer, the silver halide of which essentially consists of silver chloride, and in operative contact therewith at least one non-diffusing ballasted dye or dye precursor which when contacted with an aqueous alkaline liquid remains immobile in a waterpermeable colloid layer, and which when reacted with a reducing compound in the presence of an aqueous alkaline liquid sets free the diffusible dye or dye precursor, (2) treating the photographic material with an alkaline processing liquid in the presence of a silver halide developing agent to effect development of the exposed silver halide emulsion layer, thereby image-wise oxidizing the developing agent and as an inverse function of image-wise silver halide development reducing said non-diffusing ballasted compound, (3) maintaining said photographic material in contact with the alkaline processing liquid in the presence of said developing agent for a time sufficient to release said dye or dye precursor in diffusible state from the reduced ballasted compound(s); and (4) transferring at least a portion of said released dye or dye precursor to a non-light-sensitive layer acting as a receptor layer to form a dye image thereon, characterized in that the development proceeds in the presence of free iodide ions.

In order to ensure that the development of the developable silver chloride proceeds in intimate association with the free iodide ions these ions may be provided in the photographic material already before development e.g. in the coating stage of its water permeable layer(s) or preferably provided from an aqueous alkaline processing liquid used in the development stage which liquid will permeate the waterpermeable layer(s) of the photographic material. Free iodide ions are supplied by watersoluble iodide compounds, hereby excluding silver iodide which has a very low solubility product.

The advantageous effects of increased development speed and reduced fog are not observed when the silver halide consists of silver bromide or silver bromide-iodide. The effects are of practically value when the silver halide consists for at least 90 mole % of silver chloride and preferably silver chloride grains are used that contain only traces of bromide and/or iodide.

By the terminology "essentially consists of silver chloride" is meant that at least 90 mole % of the silver halide is silver chloride.

According to a preferred embodiment the free iodide ions are provided by potassium iodide but may stem from any watersoluble metal or onium salt providing iodide ions in aqueous alkaline medium.

According to a preferred embodiment potassium iodide is applied in said alkaline processing liquid in a concentration of 0.5 to 10 g per liter; more preferably 2 to 4 g are used per liter.

In said liquid the iodide ion providing substance may be used in conjunction with (a) silver halide complexing agent(s) e.g. a water-soluble thiosulphate, a thiocyanate, a thiosugar, a thioether acid or an active methylene compound having the methylene group linked directly to sulphonyl groups mentioned in the published European Patent Application No. 0049002. The combined use of the free iodide ions with said silver halide complexing agent(s) results unexpectedly in an increased maximum density without increase of dye fog (see the Example).

According to a preferred embodiment said processing liquid also contains a saturated, aliphatic or alicyclic amino alcohol having from 2 to 10 carbon atoms and at least two hydroxy groups, dimethylformamide, N-methyl-2-pyrrolidinone and/or an aliphatic or cycloaliphatic hydroxy compound that is not completely miscible with water at 20° C.

The term "non-diffusing" used herein has the meaning commonly applied to the term in photography and denotes materials that in any practical application do not migrate or wander through organic colloid layers, e.g. gelatin, when permeated with an aqueous alkaline liquid. The same meaning is to be attached to the term "immobile".

The term "diffusible" as applied to the materials of this invention has the converse meaning and denotes materials having the property of diffusing effectively through the colloid layers of the photographic elements when applying an aqueous alkaline liquid. "Mobile" has the same meaning.

By "operative contact" is meant that for producing diffusion transfer of an image-wise released dye or dye precursor compound on applying an alkaline processing liquid in the presence of a photographic silver halide developing agent, said compound releasing a dye or dye precursor can come into chemically reactive contact with unoxidized developing agent in an amount that is controlled by the image-wise developable silver halide of the image-wise photo-exposed silver halide emulsion layer. The quoted terms are sufficiently known to those skilled in the art.

In one type of IHR compounds described in U.S. Pat. No. 4,139,379 an image-wise dye release by reaction with a reducing agent proceeds e.g. according to the following reaction mechanism illustrated with simplified general formulae of quinonoid compounds (I):

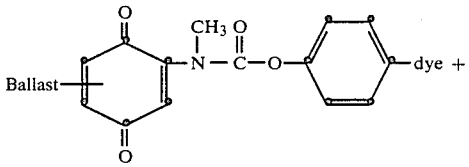

(I)

reducing agent ⟶

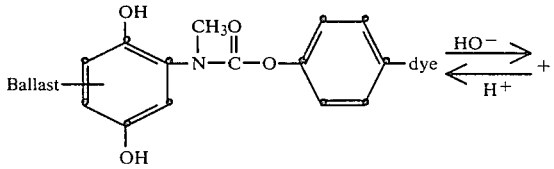

(II)

$H_2O$ ⟶

-continued

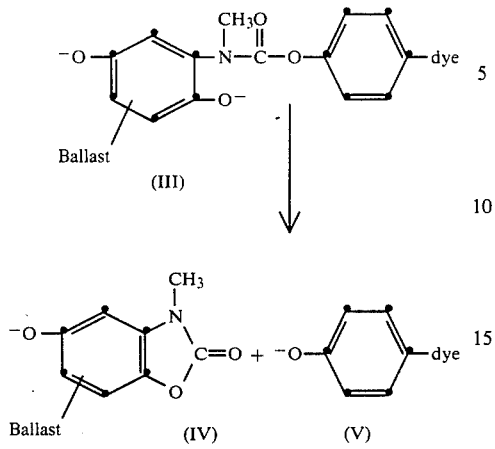

The dye compound (V) is released where the nucleophilic group, here the hydroxyl group of the hydroquinone, can attack the carbamate ester linkage. However, when the nucleophilic group is oxidized, which is the case in the quinone form, nucleophilic displacement is impossible. The compounds of the above formula (I) are referred to in said U.S. Pat. No. 4,139,379 as BEND-compounds wherein BEND is an acronym for Ballasted Electron-accepting Nucleophilic Displacement.

As is known in the art, "Ballast" stands for ballasting group, which group makes the molecule immobile. The ballasting group may be present as a substituent on the quinone nucleus. Thus, said BEND-compounds used according to the present invention are ballasted compounds capable of undergoing an electron-accepting nucleophilic displacement reaction separating hereby in alkaline medium a diffusible dye or dye precursor moiety.

Other particularly useful compounds releasing a dye or dye precursor in the process according to the present invention are described in the published European Patent Application No. 0 004 339. In the latter Application quinone-type or quinonoid compounds are described, which compounds by reduction yield hydroquinone type compounds that through the action of alkali ($HO^-$) are split into a ballasted quinone methide compound and a diffusible compound containing a dye moiety or dye precursor moiety.

The image-wise dye release by reaction with a reducing agent proceeds according to the following reaction mechanism illustrated with simplified general formule of quinonoid compounds (I)[1]:

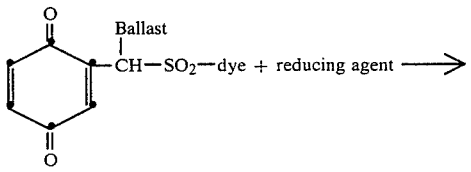

(I)[1]

-continued

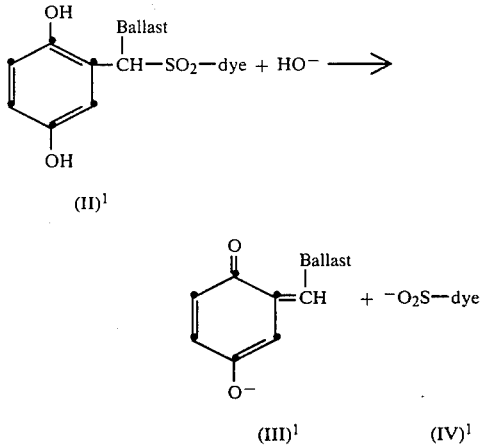

The above BEND compounds and quinone-methide-yielding compounds are IHR-compounds the hydrolysability of which is increased by reduction. The IHR-compounds applied in the present invention release in reduced state under alkaline conditions a diffusible dye or dye precursor moiety.

According to one embodiment of the present invention the above process is carried out with a photographic material containing at least two differently spectrally sensitized silver halide emulsion layers and a different IHR-compound in operative contact with each silver halide emulsion layer. The IHR-compound comprises a dye-providing moiety, which includes a dye, a shifted dye or a dye precursor such as an oxichromic compound or a colour coupler.

In a preferred embodiment the process of the present invention is carried out with a photographic multilayer, multicolour material, which comprises on a support a red-sensitive silver halide emulsion layer containing a non-diffusing dye providing compound comprising a diffusible moiety providing a cyan image dye, a green-sensitive silver halide emulsion layer containing a non-diffusing dye providing compound comprising a diffusible moiety providing a magenta image dye, and a blue-sensitive silver halide emulsion layer containing a non-diffusing dye providing compound comprising a diffusible moiety providing a yellow image dye.

The moiety providing the image dye may be a preformed dye or a shifted dye. Dye materials of this type are well-known in the art and include azo dyes, azomethine (imine) dyes, anthraquinone dyes, alizarine dyes, merocyanine dyes, quinoline dyes, cyanine dyes and the like. As is known in the art, shifted dyes include those compounds whose light-absorption characteristics are shifted hypsochromically or bathochromically when subjected to a different environment such as a change in pH, a reaction with a material to form a complex, a tautomerization, reactions to change the pKa of the compound, a removal of a group such as a hydrolyzable acyl group connected to an atom of the chromophore as mentioned in U.S. Pat. No. 3,260,597. In certain embodiments the shifted dyes are highly preferred, especially those containing a hydrolyzable group on an atom affecting the chromophore resonance structure, since the compounds can be incorporated directly in a silver halide emulsion layer or even on the exposure side thereof without substantial reduction of the light that is effective in the exposure of the silver halide.

After exposure the dye can be shifted to the appropriate colour such as, e.g., by hydrolytic removal of an acyl group to provide the respective image dye.

In another embodiment the compounds used in this invention contain an image dye-providing moiety, which is an image-dye precursor. The term "image-dye precursor" is understood to refer to those compounds that undergo reactions encountered in a photographic imaging system to produce an image dye such as colour couplers, oxichromic compounds, and the like.

When colour couplers are used they can be released in areas where no development occurs and can diffuse to an adjacent layer where they can be made to react with an oxidized colour developer such as an oxidized primary aromatic amine to form the image dye. Generally, the colour coupler and the colour developer are chosen so that the reaction product is immobile. Typical useful colour couplers include the pyrazolone couplers, pyrazolotriazole couplers, open-chain ketomethylene couplers, phenolic couplers and the like. Further reference to the description of appropriate couplers is found in U.S. Pat. No. 3,620,747 of John C. Marchant and Robert F. Motter, issued Nov. 16, 1971, which are incorporated herein by reference.

The compounds containing oxichromic moieties can be advantageously used in a photographic system since they are generally colourless materials because of the absence of an image-dye chromophore. Thus, they can be used directly in the photographic emulsion or on the exposure side thereof without competitive absorption. Compounds of this type are those compounds that undergo chromogenic oxidation to form the respective image dye. The oxidation can be carried out by aerial oxidation, incorporation of oxidants into the photographic element or film unit, or use of an oxidant during processing. Compounds of this type have been referred to in the art as leuco compounds, i.e. compounds that have no colour. Typical useful oxichromic compounds include leuco indoanilines, leuco indophenols, leuco anthraquinones and the like.

In the process of the present invention a silver halide developing agent is used that has sufficient reducing power to reduce photo-exposed silver halide at a rate faster than in the reduction of the applied IHR compounds.

Photographic silver halide developing agents suitable for that purpose can be found by simple tests by using them in combination with an elected set of silver chloride and IHR compound.

Typical useful silver halide developing agents applicable in the present invention include: hydroquinone compounds, 1-arylpyrazolidin-3-one compounds, pyrogallol and substituted pyrogallol compounds and ascorbic acid or mixtures thereof.

It is preferred to carry out the colour diffusion transfer process with the IHR-compounds in conjunction with a mixture of reducing agents at least one of which is a compound called electron donor (ED-compound) and at least one of which is a compound called electron-transfer agent (ETA-compound).

The ED-compounds are preferably non-diffusing e.g. provided with a ballasting group so that they remain within the layer unit wherein they have to transfer their electrons to the quinonoid compound.

The ED-compound is preferably present in non-diffusible state in each negative working silver halide emulsion layer containing a different non-diffusible dye or dye precursor. Examples of such ED-compound are ascorbyl palmitate and 2,5-bis(1',1',3',3'-tetramethylbutyl)-hydroquinone. Other ED-compounds are disclosed in U.S. Pat. No. 4,139,379 and in published German Patent Application No. 2 947 425. Instead of an ED-compound an electron-donor precursor compound can be used in the photographic material as described e.g. in published German Patent Application No. 2 809 716 and in U.S. Pat. No. 4,278,750. Particularly useful ED-precursor compounds for combination with the IHR compounds are benzofuran derivatives disclosed in published German Patent Application No. 3,006,268 and correspond to the following general formula:

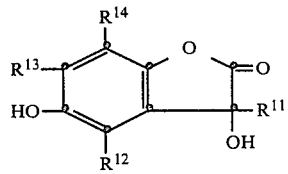

wherein:

$R^{11}$ represents a carbocyclic or heterocyclic aromatic ring, $R^{12}$, $R^{13}$ and $R^{14}$ (same or different) represent hydrogen, alkyl, alkenyl, aryl, alkoxy, alkylthio, amino, or $R^{13}$ and $R^{14}$ represent together an adjacent ring e.g. carboxyclic ring, and wherein at least one of $R^{11}$, $R^{12}$, $R^{13}$ and $R^{14}$ represent a ballast group having from 10–22 carbon atoms.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

Typically useful ETA-compounds include hydroquinone compounds, aminophenol compounds, catechol compounds, phenylene diamines and 3-pyrazolidinone compounds e.g. 1-aryl-3-pyrazolidinone as defined e.g. in U.S. Pat. No. 4,139,379.

A combination of different ETA's such as those disclosed in U.S. Pat. No. 3,039,869 can also be employed. Such developing agents can be employed in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and IHR-compound used in the process and the processing conditions for the particular photographic element.

The concentration of ED-compound or ED-precursor compound in the photographic material may vary within a broad range but is, e.g., in the molar range of 1:1 to 8:1 with respect to the IHR-compound. The ETA-compound may be present in the alkaline aqueous liquid used in the development step, but is used preferably in diffusible form in a non-sensitive hydrophilic colloid layer adjacent to at least one silver halide emulsion layer.

In order to obtain a more correct colour rendition it is also advantageous to intercept oxidized ETA-compound and to prevent it from migrating to adjacent imaging layers where it could cause the undesired oxidation of ED-compound. For said interception so-called scavengers are used that are incorporated in the photographic material in non-diffusible state e.g. in interlayers between the imaging layers. Suitable scavengers for that purpose are described e.g. in U.S. Pat. No. 4,205,987 and European Pat. No. 29546.

In a photographic element for use according to the invention and containing two or more silver halide emulsion layers, each silver halide emulsion layer containing a dye image-providing material or having the dye image-providing material present in a contiguous layer may be separated from the other silver halide emulsion layer(s) in the film unit by (an) interlayer(s), including e.g. gelatin, calcium alginate, or any of the colloids disclosed in U.S. Pat. No. 3,384,483 of Richard W. Becker, issued May 21, 1968, polymeric materials such as polyvinylamides as disclosed in U.S. Pat. No. 3,421,892 of Lloyd D. Taylor, issued Jan. 14, 1969, or any of those disclosed in French Patent Specification No. 2,028,236 filed Jan. 13, 1970 by Polaroid Corporation or U.S. Pat. Nos. 2,992,104 of Howard C. Haas, issued July 11, 1961 and 3,427,158 of David P. Carlson and Jerome L. Reid, issued Feb. 11, 1969.

According to an embodiment in the preparation of a multicolour diffusion transfer material for use according to the present invention, a water-permeable colloid interlayer dyed with a yellow non-diffusing dye or Carey Lea silver is applied below the blue-sensitive silver halide emulsion layer containing a yellow dye-releasing compound.

For in-camera processing the photosensitive material is preferably composed such that the photosensitive silver halide emulsion layer(s) is (are) negative-working and applied to the same support as the receptor layer so as to form an integral combination of light-sensitive layer(s) and a non light-sensitive layer receiver element preferably with an opaque layer, which is alkali-permeable, reflective to light and located between the receptor layer and the silver halide emulsion layer(s). In a process using such material the alkaline processing composition may be applied between the outer photosensitive layer of the photographic element and a cover sheet, which may be transparent and superposed before exposure.

In certain embodiments of the invention and especially with integral format film units, an opacifying agent can be applied from a processing composition. Examples of opacifying agents include carbon black, barium sulphate, zinc oxide, barium stearate, silicates, alumina, zirconium oxide, zirconium acetyl acetate, sodium zirconium sulphate, kaolin, mica, titanium dioxide, organic dyes such as indicator dyes, nigrosines, or mixtures thereof in widely varying amounts depending upon the degree of opacity desired. In general, the concentration of opacifying agent should be sufficient to prevent further exposure of the silver halide emulsion or emulsions of the film unit by ambient actinic radiation through the layer of processing composition, either by direct exposure through a support or by light piping from the edge of the element. For example, carbon black or titanium dioxide will generally provide sufficient opacity when they are present in the processing slution in an amount of from about 5 to 40% by weight. After the processing solution and opacifying agent have been distributed into the film unit, processing may take place out of the camera in the presence of actinic radiation in view of the fact that the silver halide emulsion(s) of the laminate is (are) appropriately protected against incident radiation, at one major surface by the opaque processing composition and at the remaining major surface by the opaque layer that is permeable to alkaline solutions. In certain embodiments, ballasted indicator dyes or dye precursors can be incorporated in a layer on the exposure side of the photosensitive layers; the indicator dye is preferably transparent during exposure and becomes opaque when contacted with the processing composition. Opaque binding tapes can also be used to prevent edge leakage of actinic radiation incident on the silver halide emulsion.

When titanium dioxide or other white pigments are employed as the opacifying agent in the processing composition, it may also be desirable to employ in cooperative relationship therewith a pH-sensitive opacifying dye such as a phthalein dye. Such dyes are light-absorbing or coloured at the pH at which image formation is effected and colourless or not light-absorbing at a lower pH. Other details concerning these opacifying dyes are described in French Patent Specification No. 2,026,927 filed Dec. 22, 1969 by Polaroid Corporation.

The substantially opaque, light-reflective layer, which is permeable to alkaline solutions, in the integral receiver film units of the present invention can generally comprise any opacifier dispersed in a binder as long as it has the desired properties. Particularly desirable are white light-reflective layers since they present esthetically pleasing backgrounds on which to view a transferred dye image and also possess the optical properties desired for reflection of incident radiation. Suitable opacifying agents include, as already mentioned with respect to the processing composition, titanium dioxide, barium sulphate, zinc oxide, barium stearate, silver flake, silicates, alumina, zirconium oxide, zirconium acetyl acetate, sodium zirconium sulphate, kaolin, mica, or mixtures thereof in widely varying amounts depending upon the degree of opacity desired. The opacifying agents may be dispersed in any binder such as an alkaline solution-permeable polymeric matrix such as, for example, gelatin, polyvinyl alcohol, and the like. Brightening agents such as the stilbenes, coumarins, triazines and oxazoles may also be added to the light-reflective layer, if desired. When it is desired to increase the opacifying capacity of the light-reflective layer, dark-coloured opacifying agents may be added to it, e.g., carbon black, nigrosine dyes, etc. Another technique to increase the opacifying capacity of the light-reflective layer is to employ a separate opaque layer underneath it comprising, e.g., carbon black, nigrosine dyes, etc., dispersed in a polymeric matrix that is permeable to alkaline solutions such as, e.g., gelatin, polyvinyl alcohol, and the like. Such an opaque layer would generally have a density of at least 4 and preferably greater than 7 and would be substantially opaque to actinic radiation. The opaque layer may also be combined with a developer scavenger layer if one is present. The light-reflective and opaque layers are generally 0.025 to 0.15 mm in thickness, although they can be varied depending upon the opacifying agent employed, the degree of opacity desired, etc.

The photosensitive substances used in this invention are preferably pure silver chloride grains or such grains that contain not more than 5 mole % of another halide e.g. bromide. The emulsions may be coarseor fine-grain and can be prepared by any of the well-known procedures, e.g., single-jet emulsions, double-jet emulsions, such as Lippmann emulsions, ammoniacal emulsions, thiocyanateor thioether-ripened emulsions.

Silver chloride emulsions useful in our invention are well-known to those skilled in the art. More details about their composition, preparation and coating are described, e.g., in Product Licensing Index, Vol. 92, December 1971, publication 9232, p. 107–109.

According to one embodiment, the silver halide emulsion layers comprise photosensitive silver chloride dispersed in gelatin and are about 0.2 to 2 μm thick; the dye image-providing materials are dispersed in a polymeric binder permeable to alkaline solutions, such as gelatin, to form a separate layer of about 1 to 7 μm thick, in combination with polymeric interlayers permeable to alkaline solutions, e.g., gelatin, being about 1 to 5 μm thick. Of course, these thicknesses are approximate only and may be modified according to the product desired.

The support for the photographic elements for use in this invention may be any material as long as it does not deleteriously affect the photographic properties of the film unit and is dimensionally stable. Typical flexible sheet materials are paper supports, e.g. coated at one or both sides with an α-olefin polymer, e.g. polyethylene; they include cellulose nitrate film, cellulose acetate film, poly(vinyl acetal) film, polystyrene film, poly(ethylene terephthalate) film, polycarbonate film, polyα-olefins such as polyethylene and polypropylene film, and related films or resinous materials. The support is usually about 0.05 to 0.15 mm thick.

For use in colour photography any material can be employed as the image-receiving layer as long as the desired function of mordanting or otherwise fixing the diffused dye will be obtained. The particular material chosen will, of course, depend upon the dye to be mordanted. If acid dyes are to be mordanted, the image-receiving layer can be composed of or contain basic polymeric mordants such as polymers of amino-guanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the 2-vinylpyridine polymer metho-p-toluene sulphonate and similar compounds described in U.S. Pat. No. 2,484,430 of Robert H. Sprague and Leslie G. Brooker, issued Oct. 11, 1949, the compounds described in the published German Patent Application No. 2,200,063 filed Jan. 11, 1971 by Agfa-Gevaert A. G. Suitable mordanting binders include, e.g. guanylhydrazone derivatives of acyl styrene polymers, as described e.g. in published German Patent Specification No. 2,009,498 filed Feb. 28, 1970 by Agfa-Gevaert A. G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. Nos. 3,271,147 of Walter M. Bush and 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solution, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkyl-phenols, etc.

Use of pH-lowering material in the dye-image-receiving element of a film unit according to the invention will usually increase the stability of the transferred image. Generally, the pH-lowering material will effect a reduction of the pH of the image layer from about 13 or 14 to at least 11 and preferably 5 to 8 within a short time after inhibition. For example, polymeric acids as disclosed in U.S. Pat. No. 3,362,819 of Edwin H. Land, issued Jan. 9, 1968 or solid acids or metallic salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed in practice over the pH-lowering layer, which "times" or controls the pH reduction depending on the rate at which alkali diffuses through the inert spacer layer. Examples of such timing layers include gelatin, polyvinyl alcohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures, e.g., premature pH reduction is prevented when inbibition is effected at temperatures above room temperature, e.g. at 35° to 37° C. The timing layer is usually about 2.5 μm to about 18 μm thick. Especially good results are obtained when the timing layer comprises a hydrolysable polymer or a mixture of such polymers that are slowly hydrolysed by the processing composition. Examples of such hydrolyable polymers include polyvinyl acetate, polyamide, cellulose esters, etc.

An alkaline processing composition employed in this invention can be a conventional aqueous solution of an alkaline material, e.g. sodium hydroxide, sodium carbonate or an amine such as diethylamine, preferably possessing a pH beyond 11.

Independent from the use of the iodide ion providing substance or in admixture therewith improved dye densities are obtained in the dye diffusion transfer process applying IHR-compounds when the alkaline processing liquid contains a saturated, aliphatic or alicyclic amino alcohol having from 2 to 10 carbon atoms and at least two hydroxy groups. Particularly high dye densities are obtained when using in said processing liquid triisopropanolamine. Other suitable dye density improving solvents, optionally used in admixture, are dimethylformamide, N-methyl-2-pyrrolidone and an aliphatic or cycloaliphatic hydroxy-compound being e.g. a monoalcohol, diol or thiol that is not completely miscible with water at 20° C. Preferred examples thereof are n-butanol, isobutanol, 2,2-diethyl-propanel,3-diol, 1-phenyl-ethane-1,2-diol (styrene glycol), 2,2,4,4-tetramethyl-butane-1,3-diol, 2-ethyl-hexane-1,3-diol and 1,4-cyclohexanedimethanol.

According to one embodiment the alkaline processing liquid contains diffusible alkyl or aryl-substituted hydroquinones in admixture with a 3-pyrazolidinone developing agent such as 1-phenyl-4-methyl-3-pyrazolidinone.

The alkaline processing composition employed in this invention may also contain a desensitizing agent such as methylene blue, nitro-substituted heterocyclic compounds, 4,4'-bipyridinium salts, etc., to insure that the photosensitive element is for further exposed after it is removed from the camera for processing.

For in-camera processing the processing composition also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of about 1 to about 5% by weight of the processing composition is preferred. It will impart thereto a viscosity of about 100 mPa.s to about 200,000 mPa.s.

Processing may proceed in a tray developing unit as is present, e.g., in an ordinary silver complex diffusion transfer (DTR) apparatus in which the contacting with a separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert N.V., Mortsel/Belgium.

According to other embodiments wherein the receptor layer is integral with the photosensitive layer(s) the processing liquid is applied from a rupturable container or by spraying.

The rupturable container that may be employed in this invention may be of the type disclosed in U.S. Pat. Nos. 2,543,181 of Edwin H. Land, issued Feb. 27, 1951, 2,643,886 of Ulrich L. di Ghilini, issued June 30, 1953, 2,653,732 of Edwin H. Land, issued Sept. 29, 1953, 2,723,051 of William J. McCune Jr., issued Nov. 8, 1955, 3,056,492 and 3,056,491, both of John E. Campbell, issued Oct. 2, 1962, and 3,152,515 of Edwin H. Land, issued Oct. 13, 1964. In general such containers comprise a rectangular sheet of fluidand air-impervious material folded longitudinally upon itself to form two walls that are sealed to one another along their longitudinal and end margins to form a cavity in which processing solution is contained.

While the alkaline processing composition used in this invention can be employed in a rupturable container, as described previously, to facilitate conveniently the introduction of processing composition into the film unit, other means of discharging processing composition within the film unit could also be employed, e.g., means injecting processing solution with communicating members similar to hypodermic syringes, which are attached either to a camera cartridge, as described in U.S. Pat. No. 3,352,674 of Donald M. Harvey, issued Nov. 14, 1967.

The following Example, including comparative tests, illustrates the invention. All percentages and ratios are by weight, unless otherwise mentioned.

EXAMPLE

A subbed water-resistant paper support consisting of a paper sheet of 110 g/sq.m coated at both sides with a polyethylene stratum of 15 g/sq.m was treated with a corona discharge and thereupon coated in the mentioned order with the following layers:

| | |
|---|---|
| (1) an alkali-permeable red-light sensitive silver halide emulsion layer containing after drying per sq. m: | |
| gelatin | 1.500 g |
| cyan dye-providing quinonoid compound C of the structural formula of Table 1 hereinafter | 0.265 g |

-continued

| | |
|---|---|
| silver chloride expressed as silver nitrate (applied from a red-sensitized gelatin-silver chloride emulsion) | 0.500 g |
| 2,5-bis(1',1',3',3'-tetramethylbutyl)-hydroquinone | 0.105 g |
| (2) an interlayer containing per sq. m: | |
| gelatin | 1.300 g |
| 2(α-methyl-n-heptadecyl-5-sulphohydroquinone potassium salt | 0.115 g |
| as magenta filtering dye Pigment Red 146 (C.I. 11,000) | 0.910 g |
| (3) an alkali-permeable green-light sensitive silver halide emulsion layer containing per sq. m: | |
| gelatin | 1.500 g |
| magenta dye-providing quinonoid compound M of the structural formula of Table 1 hereinafter | 0.232 g |
| 2,5-bis(1',1',3',3'-tetramethylbutyl)-hydroquinone | 0.100 g |
| silver chloride expressed as silver nitrate (applied from a green-sensitized gelatin-silver chloride emulsion) | 0.500 g |
| (4) an interlayer containing per sq. m: | |
| gelatin | 1.150 g |
| 1-phenyl-4-methyl-3-pyrazolidinone | 0.080 g |
| 2(α-methyl-n-heptadecyl-5-sulphohydroquinone potassium salt | 0.120 g |
| as yellow filtering dye Pigment Yellow 83 (C.I. 20,000) | 1.085 g |
| (5) an alkali-permeable blue-light sensitized silver halide emulsion layer containing per sq. m: | |
| gelatin | 1.100 g |
| yellow dye-providing compound Y of the structural formula of Table 1 hereinafter | 0.465 g |
| silver chloride expressed as silver nitrate (applied from a blue-sensitive gelatin-silver chloride emulsion) | 0.500 g |
| (6) a protective layer containing per sq. m: | |
| gelatin | 1.400 g |
| 1-phenyl-4-methyl-3-pyrazolidinone | 0.150 g |

a sufficient amount of citric acid to adjust the pH of the whole layer packet at 4.5.

TABLE 1

Quinonoid compound

C

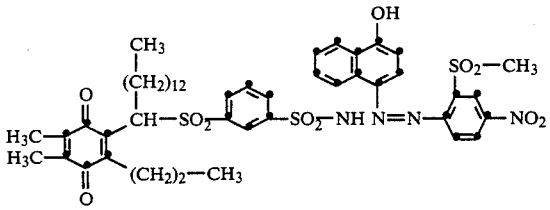

M

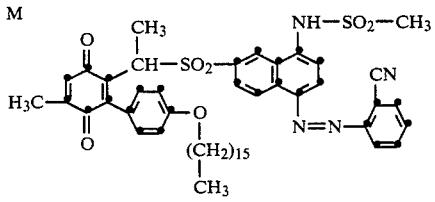

TABLE 1-continued

| Quinonoid compound |
|---|
| Y 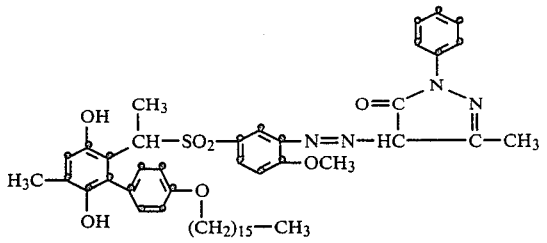 |

Composition of the receptor material

To the same support as described for the above light-sensitive material a coating having the following composition was applied per sq.m:

| | |
|---|---|
| gelatin | 5 g |
| triphenyl-n-hexadecylphosphonium bromide | 2 g |

Exposure and processing

Sheets of the obtained photographic material were exposed through a grey wedge having a constant 0.1 and thereupon contacted for 1 minute with the receptor material described hereinbefore in the COPYPROOF CP 38 (trade name) diffusion transfer processing apparatus having in its tray a basic processing composition as defined hereinafter whereto as explained in test series I and II for comparative test purposes different amounts of potassium iodide either or not in admixture with sodium thiosulphate were added.

Basic processing composition

An aqueous solution containing per liter:

| | |
|---|---|
| sodium hydroxide | 25 g |
| sodium orthophosphate | 25 g |
| cyclohexane dimethanol | 25 g |
| 2,2'-methylpropylpropane diol | 25 g |
| N—ethylbenzene-pyridinium chloride | 0.5 g |
| distilled water up to | 1000 ml |

| Test No. | Basic processing composition containing in addition per liter: |
|---|---|
| Test series I | |
| I A | 2 g of $Na_2S_2O_3$ + 0 g of KI |
| I B | 2 g of $Na_2S_2O_3$ + 0.5 g of KI |
| I C | 2 g of $Na_2S_2O_3$ + 1.0 g of KI |
| I D | 2 g of $Na_2S_2O_3$ + 2.0 g of KI |
| I E | 2 g of $Na_2S_2O_3$ + 3.0 g of KI |
| I F | 2 g of $Na_2S_2O_3$ + 5.0 g of KI |
| Test series II | |
| II A | 0 g of KI |
| II B | 2 g of KI |
| II C | 3 g of KI |
| II D | 4 g of KI |

Measurements

The minimum and maximum blue and green density values (see Table 2) of the wedge images obtained with these modified solutions of test series I and II were measured behind Kodak Wratten filters Blue No. 47, Green No. 58 with a Macbeth (trade name) densitometer RD-100 R.

The above Wratten filters manufactured by the Eastman Kodak Company have transmission curves as represented in Handbook of Chemistry and Physics, 52nd Edition, Editor Robert C. Weast—CRC Press 18901 Cranwood Parkway, Cleveland, Ohio 44128 USA p. E-218 and E-219.

TABLE 2

| | Density (D) values measured behind filters | | | |
|---|---|---|---|---|
| | blue | | green | |
| Test | Dmin | Dmax | Dmin | Dmax |
| I A | 0.17 | 1.79 | 0.21 | 1.88 |
| I B | 0.16 | 1.80 | 0.18 | 1.94 |
| I C | 0.16 | 1.82 | 0.18 | 1.91 |
| I D | 0.14 | 1.85 | 0.18 | 1.94 |
| I E | 0.14 | 1.90 | 0.17 | 1.96 |
| I F | 0.14 | 1.88 | 0.16 | 1.94 |
| II A | 0.20 | 1.84 | 0.16 | 1.87 |
| II B | 0.16 | 1.65 | 0.14 | 1.79 |
| II C | 0.15 | 1.78 | 0.14 | 1.84 |
| II D | 0.16 | 1.77 | 0.14 | 1.75 |

From the results in said Table 2 may be concluded that the maximum to minimum density ratio (Dmax/Dmin) obtained by processing in the presence of potassium iodide is higher than without the use of said iodide ion yielding substance. An analysis of the sensitometric curves corresponding with the obtained wedge prints proves an increase in sensitivity by the use of potassium iodide.

We claim:

1. A photographic colour diffusion transfer process comprising the steps:

(1) image-wise photo-exposing a photographic material which contains on a support at least one water-permeable silver halide emulsion layer, the silver halide of which essentially consists of silver chloride, and in operative contact therewith at least one non-diffusing ballasted dye or dye precursor which when contacted with an aqueous alkaline liquid remains immobile in a waterpermeable colloid layer, and which when reacted with a reducing compound in the presence of an aqueous alkaline liquid sets free the diffusible dye or dye precursor, (2) treating the photographic material with an alkaline processing liquid in the presence of a silver halide developing agent to effect development of the exposed silver halide emulsion layer, thereby image-wise oxidizing the developing agent and as an inverse function of image-wise silver halide development reducing said non-diffusing ballasted compound, (3) maintaining said photographic material in contact with the alkaline processing liquid in the presence of said developing agent for a time sufficient to release said dye or dye precursor in diffusible state from the reduced ballasted compound(s); and (4) transferring at least a portion of said released dye or dye precursor to a non-light-sensitive layer acting as a receptor layer to form a dye image thereon, characterised in that the development proceeds in the presence of free iodide ions.

2. A process according to claim 1, characterized in that the alkaline processing liquid used contains said free iodide ions.

3. A process according to claim 1, characterised in that the said non-diffusing ballasted dye or dye precursor compound is a ballasted compound capable of undergoing an electron-accepting nucleophilic displacement reaction with the said developing agent.

4. A process according to claim 1, characterised in that the said ballasted dye or dye precursor compound is capable of being split into a ballasted quinone-methide compound and a diffusible dye or dye precursor.

5. A process according to claim 1, characterised in that said developing agent is acting as an electron-transfer agent, and is used together with an electron donor which in unoxidized form is capable of reducing said non-diffusible dye or dye precursor compound, the said developing agent being a better silver halide reducing agent under the applied conditions of processing than the electron donor and providing by electron transfer an image-wise pattern of oxidized electron donor compound corresponding to the developed silver halide.

6. Process according to claim 5, characterized in that said electron donor is present in non-diffusible state in each silver halide emulsion layer containing said non-diffusing dye or dye precursor compound.

7. Process according to claim 1, characterized in that the photographic material is a photographic multilayer multicolour material comprising a support coated in successive order with:

(1) a red-sensitive silver halide emulsion layer containing a non-diffusing dye providing compound comprising a diffusible moiety providing a cyan image dye, (2) a green-sensitive silver halide emulsion layer containing a non-diffusing dye providing compound comprising a diffusible moiety providing a magenta image dye, and (3) a blue-sensitive silver halide emulsion layer containing a non-diffusing dye providing compound comprising a diffusible moiety providing a yellow image dye.

8. Process according to claim 2, characterized in that the processing liquid contains also as silver halide solvent a thiosulphate, a thiocyanate, a thiosugar, a thioether acid or an active methylene compound having the methylene group linked directly to sulphonyl groups.

9. Process according to claim 2, characterized in that said processing liquid also contains a saturated, aliphatic or alicyclic amino alcohol having from 2 to 10 carbon atoms and at least two hydroxy groups, dimethylformamide, N-methyl-2-pyrrolidinone and/or an aliphatic or cycloaliphatic hydroxy compound that is not completely miscible with water at 20° C.

10. Process according to claim 2, characterized in that said processing liquid contains potassium iodide in a concentration of 0.5 to 10 g per liter.

* * * * *